United States Patent [19]

Sauerteig et al.

[11] 4,119,464

[45] Oct. 10, 1978

[54] PROCESS FOR HARDENING PHOTOGRAPHIC LAYERS CONTAINING GELATINE

[75] Inventors: Wolfgang Sauerteig; Wolfgang Himmelmann; Rudolf Meyer; Erwin Ranz, all of Leverkusen; Willibald Pelz, Cologne, all of Germany

[73] Assignee: AGFA-Gevaert Aktiengesellschaft, Leverkusen, Germany

[21] Appl. No.: 802,001

[22] Filed: May 31, 1977

[30] Foreign Application Priority Data

Jun. 3, 1976 [DE] Fed. Rep. of Germany ..... 2625026

[51] Int. Cl.[2] ..... G03C 1/76; G03C 1/30

[52] U.S. Cl. ..... 96/68; 96/74; 96/111; 260/117; 427/338

[58] Field of Search ..... 427/338; 96/111, 68, 96/74; 106/125; 260/117

[56] References Cited

U.S. PATENT DOCUMENTS

| | | | |
|---|---|---|---|
| 3,100,704 | 8/1963 | Coles et al. | 96/111 |
| 3,880,665 | 4/1975 | Himmelmann | 96/111 |
| 3,943,019 | 3/1976 | Krekeler et al. | 96/111 |
| 4,013,468 | 3/1977 | Bergthaller et al. | 96/111 |
| 4,028,320 | 6/1977 | Sera et al. | 260/117 |
| 4,043,818 | 8/1977 | Himmelmann et al. | 427/333 |

*Primary Examiner*—Won H. Louie, Jr.
*Attorney, Agent, or Firm*—Connolly and Hutz

[57] ABSTRACT

In a process for hardening gelatine containing photographic layers, in particular multilayered photographic films, using conventional hardeners and quick acting hardeners, the surface of a layer which contains gelatine and complex forming organic or inorganic salts is exposed to the action of an aqueous solution containing a wetting agent and a quick acting hardener, the quantity of water applied with the solution being calculated so that the layer or multilayered film undergoes swelling to a certain extend, and the degree of swelling is maintained for a period from 10 to 200 seconds, whereupon the layer or multilayered film is dried at a temperature below 30° C.

12 Claims, No Drawings

PROCESS FOR HARDENING PHOTOGRAPHIC LAYERS CONTAINING GELATINE

This invention relates to a process in which photographic layers containing gelatine, in particular colour photographic layer combinations, are hardened with quick acting hardeners.

It is known that photographic layers can be hardened by coating them with aqueous solutions of cross-linking agents. The cross-linking agents used for this purpose include water-soluble aldehydes, ketones, bisvinylsulphone compounds, dichlorotriazines, bisacrylamides, bisepoxides, bisethyleneimines and bischloroacetyl compounds.

All of these compounds have, however, the disadvantage that they do not react instantly. The cross-linking reaction only sets in during drying of the films and continues for a certain length of time which may be up to one year. If the cross-linking reaction takes place mainly in the dry state, that is to say after the film has dried, then those amino groups or other groups which are adjacent to each other in the gelatine are cross-linked with each other. This results in a very close-meshed cross-linking structure. If the gelatine layer has been highly cross-linked in the dry state, however, it suffers a substantial loss in its capacity to swell in the aqueous phase. As a result, the photographic properties alter in a manner which cannot be predicted.

This process, known as after-hardening, has the effect that the photographic layer can no longer be developed and fixed in the normal manner. It would therefore be desirable to cross-link a photographic layer in such a manner that it becomes completely insoluble in aqueous solutions and that it combines a high resistance to gelling with the characteristic that its capacity to swell in water at 22° C. by about 200 to 500%, depending on the purpose for which the photographic material is to be used, can be predetermined by suitable adjustment at the stage of casting the layer and does not undergo any change during storage of the material. This object cannot be achieved with the known slowly reacting hardeners.

Hardeners which have a high reaction velocity are already known. These hardeners cause an increase in viscosity and irreversible solidification of gelatine within a relatively short time after their addition to gelatine solutions. To overcome the difficulties which this involves, hardeners of this kind are generally added to the gelatine solutions only shortly before the solutions are cast, or alternatively, layers are treated with solutions of the quick acting hardeners after they have been cast.

These methods do not obviate another disadvantage of quick acting hardeners, which is that the rapid onset of the hardening reaction, which is in itself desirable, depends on the use of relatively high concentrations of hardeners, which give rise to correspondingly large quantities of products of hydrolysis, which in turn suppress the sensitivity of the photographic emulsions and increase fogging.

It is therefore an object of the present invention to develop a process by which photographic layers can be hardened with quick acting hardeners without the disadvantages resulting from the use of the large quantities of hardeners normally required for a rapid hardening reaction.

The invention thus relates to a process for hardening photographic layers containing gelatine, in particular photographic layer combinations which comprise light-sensitive photographic layers containing gelatine and light-insensitive photographic layers containing gelatine, using conventional hardeners which react with some delay and quick acting hardeners, characterised in that the surface of a photographic layer which contains gelatine and complex-forming organic or inorganic salts of aluminium, chromium and zirconium and has a gelatine melting point above 35° C. or the surface of a layer combination consisting of such gelatine containing layers is exposed to the action of an aqueous solution containing a quick acting hardener which activates carboxyl groups and a wetting agent, the quantity of water used with the solution being calculated so that the layer or layer combination assumes a degree of swelling of between 200 and 500 vol.-%, including the amount of water already present in the layer or layer combination, and in that the state of swelling is maintained for 10 to 200 seconds and the layer or layer combination is thereafter dried at temperatures below 30° C.

Quick acting hardeners in accordance with this invention are compounds which effect cross-linking of proteins accompanied by activation of carboxyl groups and reaction with amino groups of the protein molecules.

The process according to the invention makes it possible to produce hardened photographic layers containing gelatine which have a clearly defined degree of vertical swelling and are practically free from any detectable after-hardening. To achieve this, the desired degree of swelling of the prehardened photographic layer is adjusted by covering the layer with an accurately calculated quantity of water or aqueous solution of the hardener, the degree of swelling of the layer is irreversibly fixed by reaction of the gelatine with a quick acting hardener, and the layer is not dried until most of the hardener in the layer has either undergone reaction or has been decomposed by water.

Quick acting hardeners which are particularly suitable for the process according to the invention are carbamoylonium salts, carbamoyloxypyridinium salts, carbodiimides, sulphobetaine carbodiimides, 1-N-ethoxycarboxy-2-ethoxydihydroquinolines, isoxazolium salts and bis-isoxazolium salts.

Compounds corresponding to the following general formulae are examples of hardeners from the above mentioned groups:

(I) Carbamoylonium compounds of the formula

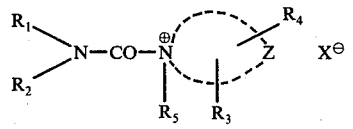

in which $R_1$ represents an alkyl group, which may be substituted preferably an alkyl group having from 1 to 3 carbon atoms, an aryl group such as phenyl which may be substituted with a lower alkyl group such as methyl, ethyl or propyl or with a halogen such as chlorine or bromine, or an aralkyl group such as benzyl which may be substituted in the same way as the aryl group;

$R_2$ may have the same meaning as $R_1$ or it may represent a divalent, alkylene, arylene, aralkylene or alkyl-aryl-alkyl group, which may be substituted such as an ethylene, propylene, phenylene, or xylylene group attached by its second bond to another carbamoylammonium group of the formula

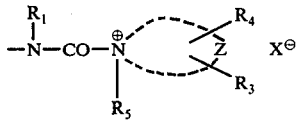

or $R_1$ and $R_2$ may together represent the atoms required to complete a piperidine, piperazine or morpholine ring, which ring may be substituted, for example with an alkyl group having from 1 to 3 carbon atoms or with a halogen such as chlorine or bromine;

$R_3$ represents a hydrogen atom; an alkyl group having from 1 to 3 carbon atoms; or the group $[A]_\alpha$ in which A represents a vinyl group of a polymerised monomer of a copolymer with other copolymerisable monomers, and $\alpha$ represents a number such that the molecular weight of the compound is greater than 1000;

$R_4$ represents a hydrogen atom; an alkyl group having 1 to 3 carbon atoms; or, when Z represents the atoms required for completing a pyridinium ring and $R_3$ is absent, $R_4$ represents one of the following groups:

—$NR^6$—CO—$R^7$ in which $R^6$ = represents hydrogen or alkyl (1 to 4 C.)

$R^7$ = represents hydrogen, alkyl (1 to 4 C.) or $NR^8R^9$ $R^8$, $R^9$ represents hydrogen or alkyl ($C_1$ to $C_4$);

—$(CH_2)_m$—$NR^{10}R^{11}$ in which $R^{10}$ represents —CO—$R^{12}$ $R^{11}$ represents hydrogen or alkyl ($C_1$–$C_4$);

$R^{12}$ represents hydrogen or alkyl ($C_1$–$C_4$) or $R^{12}$ represents $NR^{13}R^{14}$ in which $R^{13}$ represents alkyl ($C_1$–$C_4$) or aryl $R^{14}$ represents hydrogen alkyl or aryl and $m$ = 1–3

—$(CH_2)_n$—$CONR^{15}R^{16}$ in which $R^{15}$ represents hydrogen alkyl ($C_1$–$C_4$) or aryl and $R^{16}$ represents hydrogen or alkyl ($C_1$–$C_4$) or $R^{15}$ and $R^{16}$ together represent the atoms required to complete a 5- or 6-membered aliphatic ring and $n$ = 0–3 or

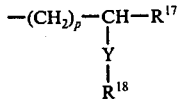

in which $R^{17}$ represents hydrogen or alkyl ($C_1$–$C_4$) which may be substituted by halogen Y represents —O— or —$NR^{19}$—

$R^{18}$ represents hydrogen, alkyl, —CO—$R^{20}$ or —CO—$NHR^{21}$;

$R^{19}$, $R^{20}$ and $R^{21}$ represent hydrogen or alkyl ($C_1$–$C_4$) and $p$ = 2–3;

$R^5$ represents alkyl, aryl or aralkyl but is absent if the nitrogen atom to which $R_5$ is normally attached carries a double bond in the heterocyclic aromatic ring formed by Z;

Z represents the atoms required to complete a substituted or unsubstituted 5- or 6-membered heterocyclic, aromatic ring or a condensed system such as isoquinoline, which atomic group may carry other hetero atoms in addition to the nitrogen atom, for example oxygen and sulphur; and X represents an anion, e.g. halogen $^-$, $BF_4^-$, $NO_3^-$, $SO_4^=$, $ClO_4^-$, or $CH_3OSO_3^-$.

(II) Carbamoylpyridinium compounds of the formula

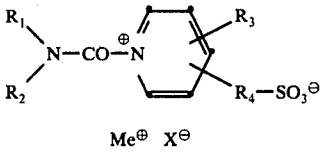

in which:

$R_1$ and $R_2$ which may be the same or different, represent an alkyl group having from 1 to 3 carbon atoms; an aryl group such as phenyl which may be substituted with a lower alkyl group such as methyl or ethyl or with halogen such as chlorine or bromine; or an aralkyl group, e.g. benzyl, which may be substituted in the same way, as the aryl group; or $R_1$ and $R_2$ may together represent the atoms required to complete a piperidine or morpholine ring, which ring may be substituted with alkyl such as methyl or ethyl or with halogen such as chlorine or bromine;

$R_3$ represents hydrogen, methyl or ethyl;

$R_4$ represents methylene, ethylene, propylene or a single chemical bond;

$Me^+$ represents an alkali metal cation such as $Li^+$, $Na^+$ or $K^+$ and $X^-$ represents an anion such as Cl′ or Br′.

(III) Carbamoyloxypyridinium compounds of the formula

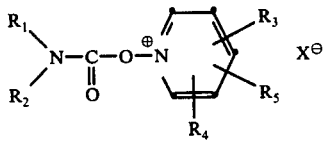

in which $R_1$ represents alkyl having from 1 to 3 carbon atoms or aryl such as phenyl;

$R_2$ represents alkyl having from 1 to 3 carbon atoms or the group

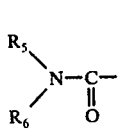

in which $R_7$ represents hydrogen or an alkyl group such as methyl or ethyl group and $R_6$ represents an alkyl group such as a methyl or ethyl group or $R_1$ and $R_2$ together represent the atoms required to complete a heterocyclic ring system such as pyrrolidine; morpholine; piperidine; perhydroazepine;

1,2,3,4-tetrahydroquinoline or imidazolidine-2-OH ring; or $R_1$ and $R_2$ together represent the atoms required to complete a piperazine ring in which the second nitrogen atom establishes the bond to another, similar molecular grouping corresponding to the general formula;

$R_3$ represents hydrogen, halogen such as chlorine or bromine alkyl such as methyl and ethyl, hydroxyalkyl with 1 to 3 carbon atoms, cyanogen, $—CONH_2$ or —NH—C—O alkyl (such as methyl, ethyl);

$R_4$ represents hydrogen or an alkyl such as methyl or ethyl; and $R_5$ represents hydrogen or methyl;

X represents an anion such as Cl—, $BF_4$— or $ClO_4$—.

(IV) Carbodiimides of the formula $$R_1—N=C=NR_2$$

in which $R_1$ and $R_2$ which may be the same or different represent alkyl such as methyl, ethyl, n-propyl, isopropyl, n-butyl, sec.butyl, isobutyl, tert.-butyl, amyl, hexyl, or cyclohexyl, alkoxyalkyl such as methoxy- or ethoxyethyl, or -propyl, amyl, aryl such as phenyl, benzyl, phenylethyl, ethylmorpholinyl, diethylaminoethyl, ethylpyridyl or α-, β- or γ-methyl- or -ethyl-pyridyl or $R_1$ represents an alkyl group with 1 to 5 carbon atoms and $R_2$ represents the group

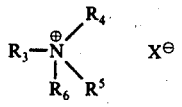

in which $R_3$ represents an alkylene group with 1 to 5 carbon atoms and $R_4$ and $R_5$ represent alkyl groups with 1 to 3 carbon atoms or $R_4$ and $R_5$ together form a 6-membered heterocyclic ring having one or two hetero atoms, e.g.

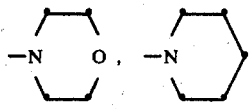

and $R_6$ represents hydrogen or a lower alkyl group and X represents an anion such as chloride, bromide or toluene sulphonate.

(V) Sulphobetaine carbodiimides of the formula

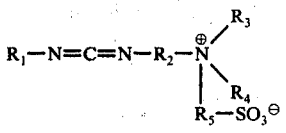

in which $R_1$ represents an alkyl group with 1 to 6 carbon atoms or a cycloalkyl or alkoxyalkyl group, $R_2$ represents an alkylene group with 2 to 4 carbon atoms, $R_3$ represents an alkyl group with 1 to 3 carbon atoms and $R_4$ represents an alkyl group with 1 to 3 carbon atoms or an aryl group such as phenyl group or $R_3$ and $R_4$ together represent the atoms required to complete a 6-membered heterocyclic ring which may contain other hetero atoms in addition to the nitrogen atom, for example a piperidine, piperazine or morpholine ring, and $R_5$ represents an alkylene group with 1 to 4 carbon atoms.

(VI) Dihydroquinoline derivatives of the formula

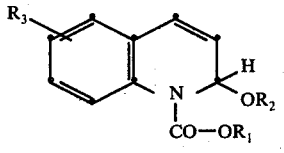

in which $R_1$ represents an alkyl group with 1 to 4 carbon atoms which may be unsubstituted or substituted with an alkyloxy group e.g. with an methoxy or ethoxy group, or with a halogen, e.g. with chlorine or bromine;

$R_2$ represents an alkyl group with 1 to 4 carbon atoms which may be unsubstituted or substituted with an alkoxy group such as a methoxy or ethoxy group or with a halogen such as chlorine or with a dialkylamino or trialkylammonium group, e.g. with dimethyl amino, diethylamino, trimethylammonium or triethylammonium or with an aryl group e.g. phenyl, or with an alkylsulphonyl group, e.g. methyl or ethyl-sulphonyl; or, when $R_3$ is absent, $R_2$ represents

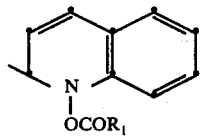

$R_3$ represents hydrogen, halogen such as chlorine or bromine, an alkoxy group such as a methoxy or alkoxy group or an alkyl group such as a methyl, ethyl or propyl group.

(VII) Isoxazolium salts of the formula

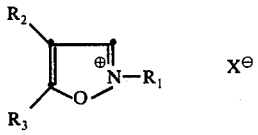

in which $R_1$ represents an aliphatic hydrocarbon group which has from 1 to 4 carbon atoms and may contain a sulphonate anion;

$R_2$ and $R_3$ represents hydrogen; unsubstituted alkyl; unsubstituted aryl; alkyl or aryl substituted with halogen, hydroxyl, alkyl, alkoxy and/or a sulphonate anion; or a simple heterocyclic ring such as a furyl ring or $R_2$ and $R_3$ may together represent an alicyclic ring;

X represents an anion which renders the compound water-soluble, e.g. perchlorate or p-toluenesulphonate, X being absent when $R_1$, $R_2$ or $R_3$ already contains or contain a sulphonate anion.

(VIII) Bis-isoxazoles and their quaternary salts of the formulae:

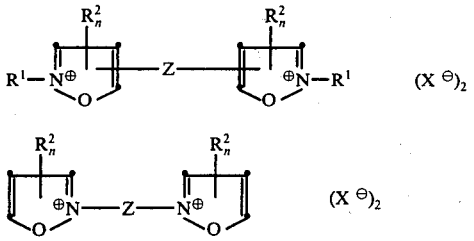

in which

Z represents a divalent aliphatic or aromatic group;

$R_1$ represents an aliphatic hydrocarbon group having from 1 to 4 carbon atoms;

$R_2$ represents an alkyl or cycloalkyl group or an aryl when it is not attached to a ring in the 3-position;

*n* represents an integer of from 0 to 2 and

X represents an anion such as perchlorate, p-toluenesulphonate, chloride or tetrafluoborate.

The following are mentioned as examples of quick acting hardener compounds corresponding to formulae I to VIII:

Compounds according to formula I

I/1.

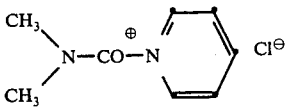

syrup, very hygroscopic

I/2.

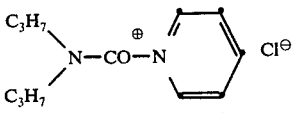

syrup, very hygroscopic

I/3.

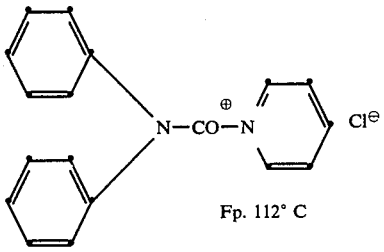

Fp. 112° C

I/4.

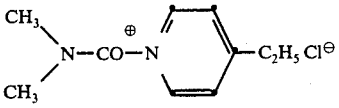

Fp. 103° C

I/5.

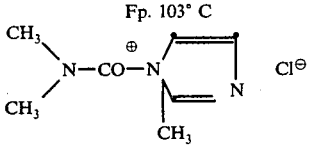

Fp. 87-89° C

I/6.

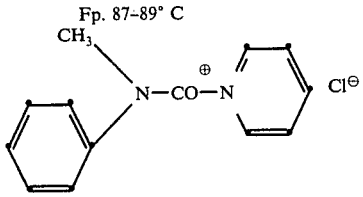

Fp. 108-110° C

I/7.

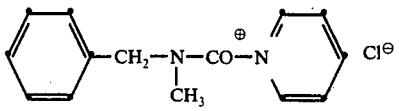

syrup, hygroscopic

I/8.

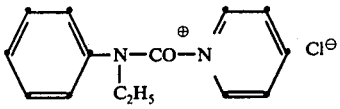

Fp. 105-107° C

I/9.

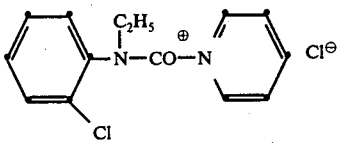

syrup

I/10.

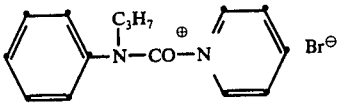

Fp. 103-105° C

I/11.

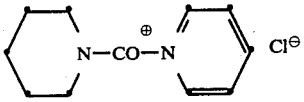

Fp. 75-77° C

I/12.

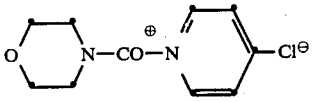

Fp. 110-112° C

I/13.

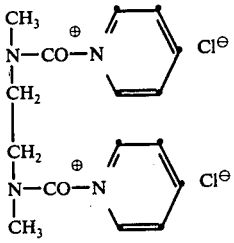

Fp. 95-96° C

I/14.

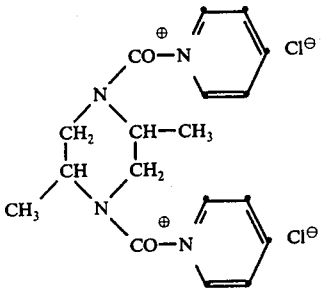

Fp. 106° C

I/15.

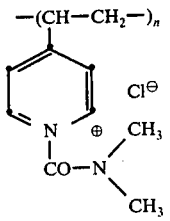

mol weight above 1000

-continued
I/16. 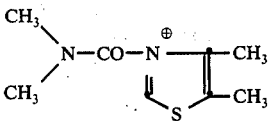
$Cl^{\ominus}$ Fp. 66–68° C
I/17. 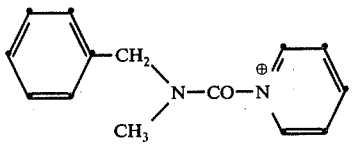
$Cl^{\ominus}$ Fp.
I/18. 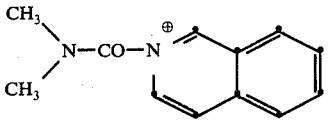
$Cl^{\ominus}$ Cl
I/19. 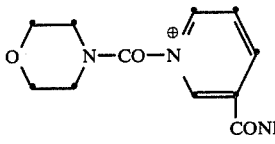
$Cl^{\ominus}$ Temp.: 103–105° C
I/20. 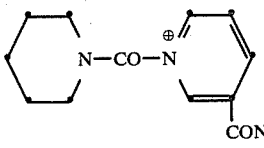
$Cl^{\ominus}$ 01
I/21. 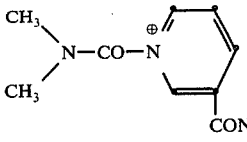
$Cl^{\ominus}$ Temp.: 109° C
I/22. 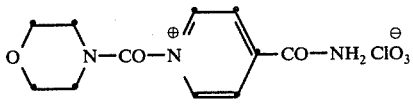
I/23. 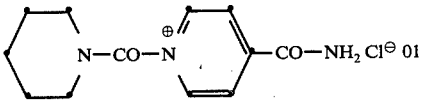
I/24. 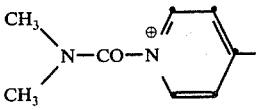
I/25. 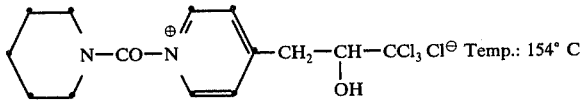
I/26. 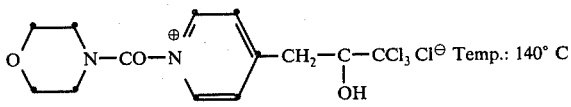
I/27. 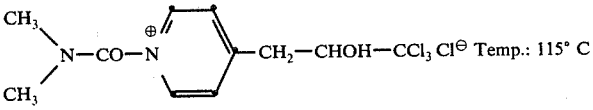
I/28. 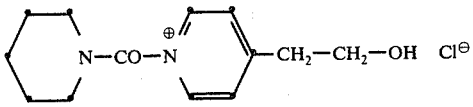
I/29. 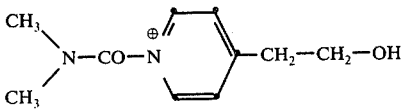

-continued
I/30.
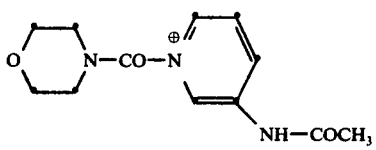
$Cl^{\ominus}$ Temp.: 118–120° C
I/31.
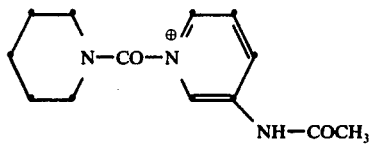
$Cl^{\ominus}$ Temp.: 90° C
I/32.
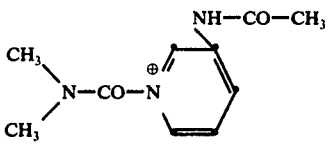
$Cl^{\ominus}$ Temp.: 210° C
I/33.
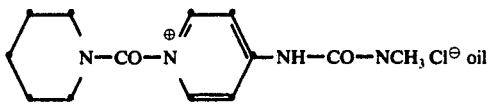
$Cl^{\ominus}$ oil
I/34.
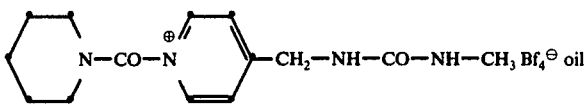
$Bf_4^{\ominus}$ oil
I/35.
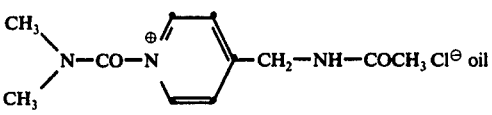
$Cl^{\ominus}$ oil
I/36.
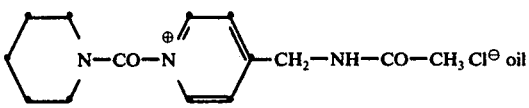
$Cl^{\ominus}$ oil
I/37.
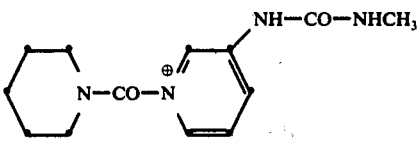
$Cl^{\ominus}$ Temp.: 60–65° C
I/38.
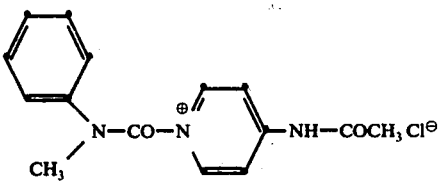
$Cl^{\ominus}$
I/39.
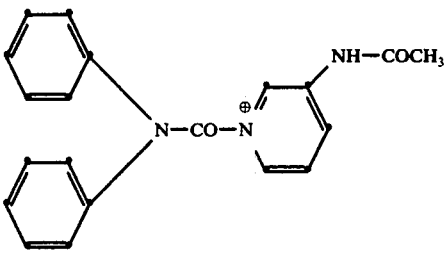
$Cl^{\ominus}$
I/40.
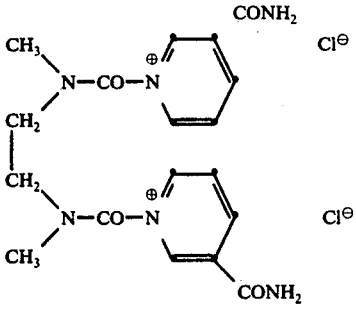
$Cl^{\ominus}$
$Cl^{\ominus}$ Compounds according to formula II
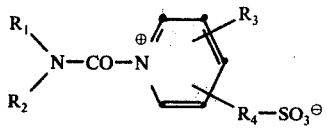
II/1.
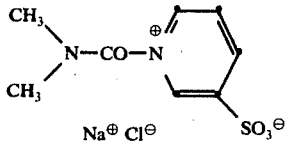
II/2.
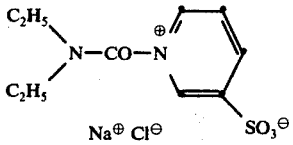
II/3.
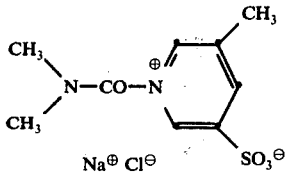
II/4.
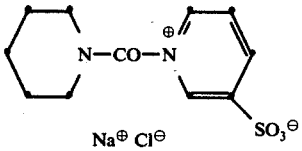
II/5.
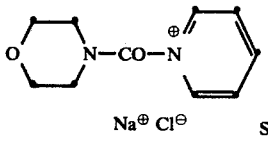
II/6.
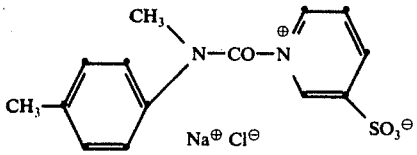
II/7.
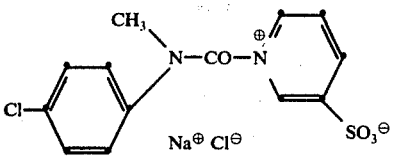
II/8.
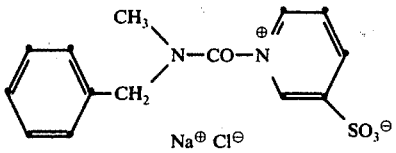
II/9.
-continued
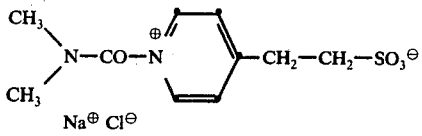
II/10.
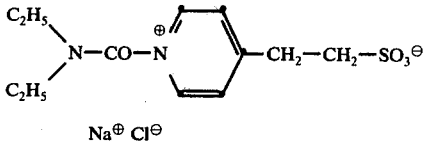
II/11.
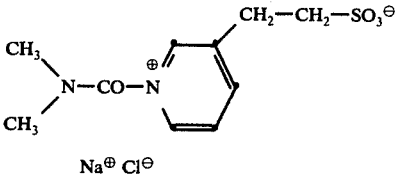
II/12.
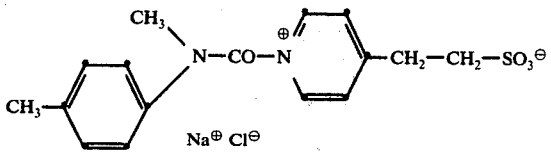
II/13.
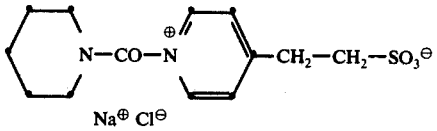
II/14.
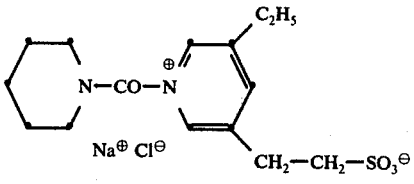
II/15.
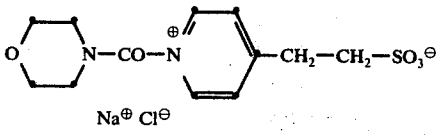
II/16.
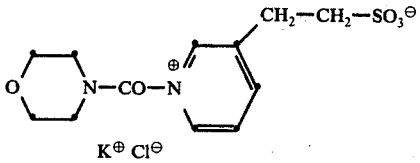
II/17.
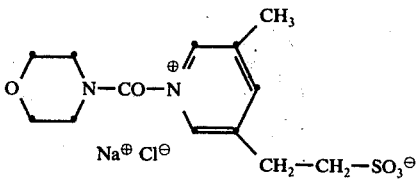
Compounds according to formula III

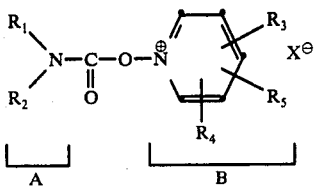
| Subst. No. | A | B | $X^{\ominus}$ | Fp. decomp. |
|---|---|---|---|---|
| III/1. | 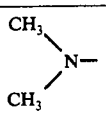 | 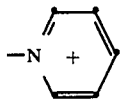 | $Cl^{\ominus}$ | 163 - 67° |
| III/2. | " | 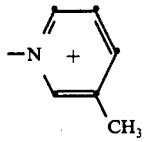 | $Cl^{\ominus}$ | 168 - 70° |
| III/3. | " | 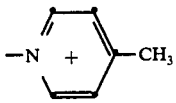 | $Cl^{\ominus}$ | 86° |
| III/4. | " | 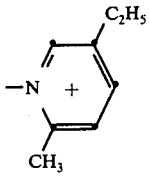 | $Cl^{\ominus}$ | 90° |
| III/5. | " | 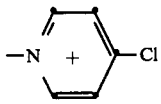 | $ClO_4^{\ominus}$ | 100 - 102° |
| III/6. | " | 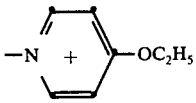 | $ClO_4^{\ominus}$ | 95 - 100° |
| III/7. | " | 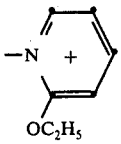 | $ClO_4^{\ominus}$ | 100 - 102° |
| III/8. | " | 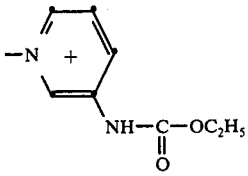 | $ClO_4^{\ominus}$ | 150° |
| III/9. | 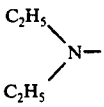 | 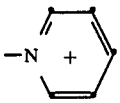 | $Cl^{\ominus}$ | 108 - 110° |
| III/10. | " | 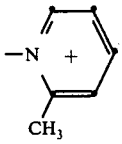 | $ClO_4^{\ominus}$ | 64 - 65° |
| III/11. | " | 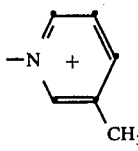 | $ClO_4^{\ominus}$ | 130 - 32° |

-continued
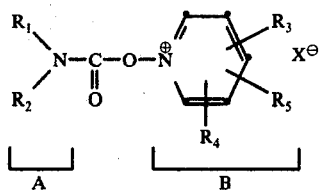
| Subst. No. | A | B | $X^{\ominus}$ | Fp. decomp. |
|---|---|---|---|---|
| III/12. | " | 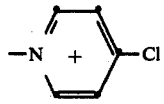 | $Cl^{\ominus}$ | 95 - 100° |
| III/13. | 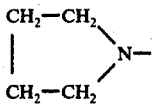 | 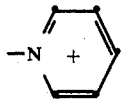 | $Cl^{\ominus}$ | 114 - 115° |
| III/14. | " | 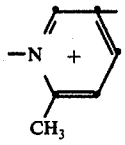 | $Cl^{\ominus}$ | 90 - 92° C |
| III/15. | 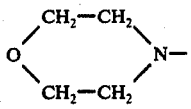 | 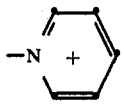 | $Cl^{\ominus}$ | 132° C |
| III/16. | " | " | $BF_4^{\ominus}$ | 138 - 40° C |
| III/17. | " | " | $ClO_4^{\ominus}$ | 150 - 52° C |
| III/18. | " | 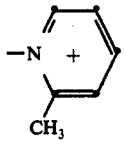 | $Cl^{\ominus}$ | 110 - 13° C |
| III/19. | " | " | $ClO_4^{\ominus}$ | 140 - 42° C |
| III/20. | " | 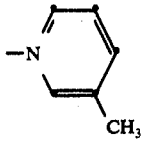 | $Cl^{\ominus}$ | 130 - 32° C |
| III/21. | " | 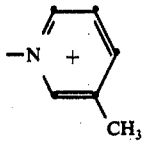 | $ClO_4^{\ominus}$ | 144 - 46° |
| III/22. | 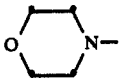 | 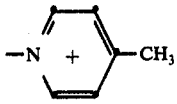 | $Cl^{\ominus}$ | >90° |
| III/23. | " | 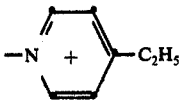 | $Cl^{\ominus}$ | 100 - 102° |
| III/24. | " | 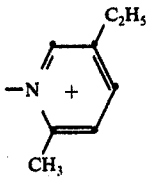 | $Cl^{\ominus}$ | 102 - 104° |
| III/25. | " | 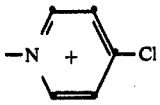 | $Cl^{\ominus}$ | 100 - 102° |

-continued
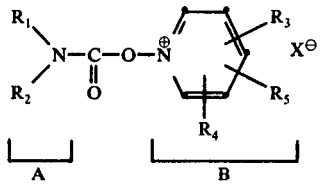
| Subst. No. | A | B | $X^{\ominus}$ | Fp. decomp. |
|---|---|---|---|---|
| III/26. | " | 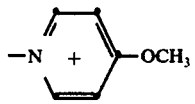 | $Cl^{\ominus}$ | 113 - 115° |
| III/27. | " | 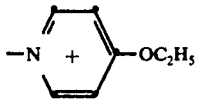 | $Cl^{\ominus}$ | >115° |
| III/28. | " | " | $ClO_4^{\ominus}$ | 112 - 14° |
| III/29. | " | 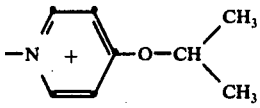 | $Cl^{\ominus}$ | 93 - 95° |
| III/30. | " | 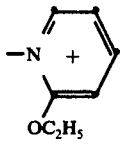 | $Cl^{\ominus}$ | 65 - 70° |
| III/31. | " | " | $BF_4^{\ominus}$ | 144 - 48° |
| III/32. | " | 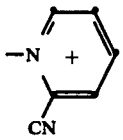 | $Cl^{\ominus}$ | 80 - 82° |
| III/33. | " | 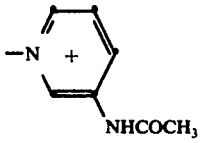 | $ClO_4^{\ominus}$ | 150° |
| III/34. | 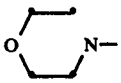 | 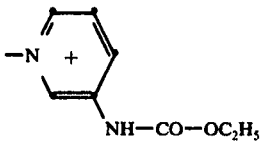 | $ClO_4^{\ominus}$ | 162 - 63° |
| III/35. | " | 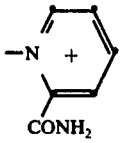 | $ClO_4^{\ominus}$ | 200° |
| III/36. | 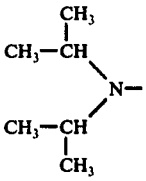 | 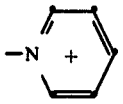 | $Cl^{\ominus}$ | 158° |
| III/37. | " | 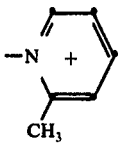 | $Cl^{\ominus}$ | 138° |

-continued
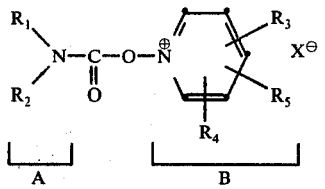
| Subst. No. | A | B | $X^{\ominus}$ | Fp. decomp. |
|---|---|---|---|---|
| III/38. | " | 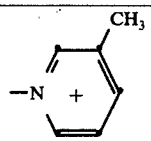 | $Cl^{\ominus}$ | 152 - 154° |
| III/39. | 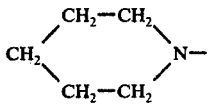 | 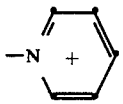 | $Cl^{\ominus}$ | 85 - 86° |
| III/40. | " | 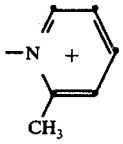 | $ClO_4^{\ominus}$ | 100° |
| III/41. | " | 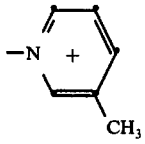 | $ClO_4^{\ominus}$ | 80° |
| III/42. | " | 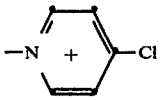 | $Cl^{\ominus}$ | 104 - 106° |
| III/43. | 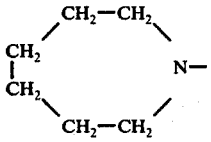 | 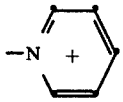 | $Cl^{\ominus}$ | 76 - 78° |
| III/44. | 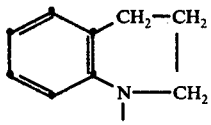 | " | $Cl^{\ominus}$ | 140 - 144° |
| III/45. | 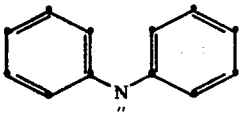 | " | $Cl^{\ominus}$ | 160 - 162° |
| III/46. | " | 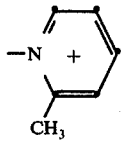 | $Cl^{\ominus}$ | 98 - 100° |
| III/47. | " | 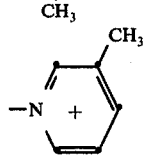 | $Cl^{\ominus}$ | 218 - 220° |
| III/48. | " | 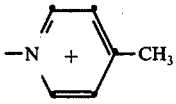 | $Cl^{\ominus}$ | 116° |
| III/49. | " | 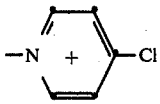 | $Cl^{\ominus}$ | 125 - 128° |

-continued

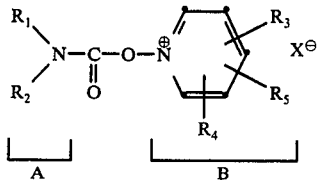

| Subst. No. | A | B | $X^{\ominus}$ | Fp. decomp. |
|---|---|---|---|---|
| III/50. | 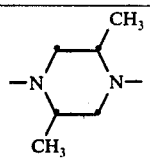 | 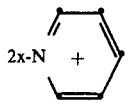 | 2 $Cl^{\ominus}$ | 109 - 112° |
| III/51. | 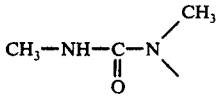 | 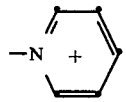 | $Cl^{\ominus}$ | 87 - 89° |
| III/52. | " | 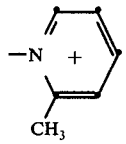 | $Cl^{\ominus}$ | 105° |
| III/53. | " | 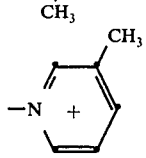 | $Cl^{\ominus}$ | 88 - 89° |
| III/54. | 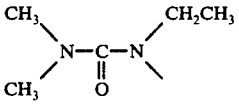 | 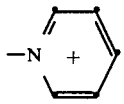 | $Cl^{\ominus}$ | 168 - 170° |
| III/55. | 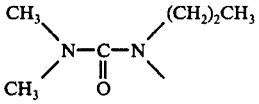 | " | $Cl^{\ominus}$ | 169 - 173° |
| III/56. | 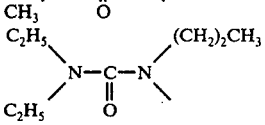 | " | $Cl^{\ominus}$ | 173 - 180° |
| III/57. | 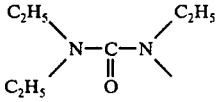 | " | $Cl^{\ominus}$ | 173 - 183° |
| III/58. | 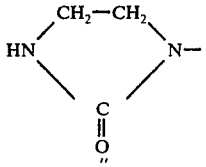 | " | $Cl^{\ominus}$ | 221 - 223° |
| III/59. | " | 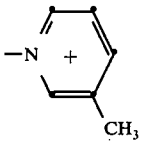 | $Cl^{\ominus}$ | 180 - 185° |

Compounds according to formula IV $C_2H_5-N=C=N-C_2H_5$ IV/1.

$CH_2=CH-CH_2-N=C=N-CH_2-CH=CH_2$ IV/2.

$CH_3O-CH_2-CH_2-N-C=N-CH_2-CH_2-OCH_3$ IV/3.

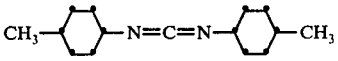 IV/4.

-continued $C_2H_5-(CH_3)CH-N=C=N-CH(CH_3)-C_2H_5$ IV/5.

$(C_2H_5)_2N-CH_2-CH_2-N=C=N-CH_2-CH_2-N(C_2H_5)_2$ IV/6.

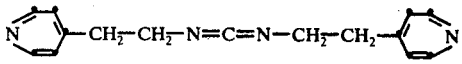 IV/7.

$CH_3-N=C=N-CH(CH_3)_2$ IV/8.

-continued $C_2H_5-N=C=N-(CH_2)_2-OCH_3$ IV/9.

$C_3H_7-N=C=N-(CH_2)_3-N$ IV/10.

$C_2H_5-N=C=N-(CH_2)_3-N\ O$ IV/11.

$N-CH_2-CH_2-N=C=N-CH_2-CH_3$ IV/12.

$N-CH_2-CH_2-N=C=N-CH_2-CH_2-O-CH_3$ IV/13.

$CH_3-N=C=N-(CH_2)_3-\overset{\oplus}{N}H(CH_3)_2\ Cl^{\ominus}$ IV/14.

$C_2H_5-N=C=N-(CH_2)_3-\overset{\oplus}{N}H(CH_3)_2\ Cl^{\ominus}$ IV/15.

$C_2H_5-N=C=N-(CH_2)_3-\overset{\oplus}{N}(CH_3)_3\ Cl^{\ominus}$ IV/16.

$C_5H_{11}-N=C=N-(CH_2)_3-\overset{\oplus}{N}H(C_2H_5)_2\ Cl^{\ominus}$ IV/17.

$CH_3-N=C=N-CH_2-CH_2-\overset{\oplus}{N}(CH_3)\ X^{\ominus}$ IV/18.

$CH_3-O-CH_2-CH_2-N=C=N-CH_2-CH_2-\overset{\oplus}{N}(CH_3)\ O\ Cl^{\ominus}$ IV/19.

$H-N=C=N-CH_2-CH_2-\overset{\oplus}{N}(CH_3)\ Cl^{\ominus}$ IV/20.

$N-CH_2-CH_2-N=C=N-CH_2-CH_2-CH_2-\overset{\oplus}{N}(CH_3)\ O\ Cl^{\ominus}$ IV/21.

Compounds according to formula V $CH_3-N=C=N-(CH_2)_3-\overset{\oplus}{N}(CH_3)_2\ (CH_2)_4-SO_3^{\ominus}$ V/1.

$C_2H_5-N=C=N-(CH_2)_3-\overset{\oplus}{N}(CH_3)_2\ (CH_2)_4-SO_3^{\ominus}$ V/2.

i. $C_3H_7-N=C=N-(CH_2)_3-\overset{\oplus}{N}(CH_3)_2\ (CH_2)_4-SO_3^{\ominus}$ V/3.

$H-N=C=N-(CH_2)_3-\overset{\oplus}{N}(CH_3)_2\ (CH_2)_4-SO_3^{\ominus}$ V/4.

-continued $CH_3-N=C=N-(CH_2)_3-\overset{\oplus}{N}(C_2H_5)_2\ (CH_2)_4-SO_3^{\ominus}$ V/5.

$C_2H_5-N=C=N-(CH_2)_3-N(C_2H_5)_2\ (CH_2)_4-SO_3^{\ominus}$ V/6.

$i\text{-}C_3H_7-N=C=N-(CH_2)_3-\overset{\oplus}{N}(C_2H_5)_2\ (CH_2)_4-SO_3^{\ominus}$ V/7.

$N=C=N-(CH_2)_3-\overset{\oplus}{N}(C_2H_5)_2\ (CH_2)_4-SO_3^{\ominus}$ V/8.

$CH_3-N=C=N-(CH_2)_3-\overset{\oplus}{N}\ O\ (CH_2)_4-SO_3^{\ominus}$ V/9.

$C_2H_5-N=C=N-(CH_2)_3-\overset{\oplus}{N}\ O\ (CH_2)_4-SO_3^{\ominus}$ V/10.

$CH_3-N=C=N-(CH_2)_3-\overset{\oplus}{N}(CH_3)_2\ (CH_2)_3-SO_3^{\ominus}$ V/11.

$CH_3-N=C=N-(CH_2)_3-\overset{\oplus}{N}(CH_3)_2\ CH_3-CH_2\ CH_2-CH-SO_3^{\ominus}$ V/12.

$CH_3-N=C=N-(CH_2)_3-\overset{\oplus}{N}(CH_3)_2\ CH_2-SO_3^{\ominus}$ V/13.

$CH_3-N=C=N-(CH_2)_3-\overset{\oplus}{N}(CH_3)\ (CH_2)_4-SO_3^{\ominus}$ V/14.

$C_2H_5-N=C=N-(CH_2)_3-\overset{\oplus}{N}(CH_3)_2\ CH_2-SO_3^{\ominus}$ V/15.

$C_2H_5-N=C=N-CH(CH_3)-CH_2-\overset{\oplus}{N}(CH_3)_2\ (CH_2)_4-SO_3^{\ominus}$ V/16.

$(CH_3)_3-N=C=N-(CH_2)_3-\overset{\oplus}{N}(CH_3)_2\ (CH_2)_3-SO_3^{\ominus}$ V/17.

$C_2H_5-N=C=N-(CH_2)_3-\overset{\oplus}{N}\ (CH_2)_4-SO_3^{\ominus}$ V/18.

$i\text{-}C_3H_7-N=C=N-(CH_2)_4-\overset{\oplus}{N}\ NCH_3\ (CH_2)_4-SO_3^{\ominus}$ V/19.

-continued

V/20. $CH_3-O-CH_2-N=C=N-(CH_2)_3-\overset{\oplus}{N}(CH_3)_2-(CH_2)_4-SO_3^{\ominus}$ -continued VII/7. 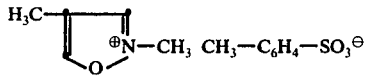

VII/8. 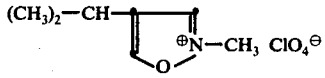

Compounds according to formula VI

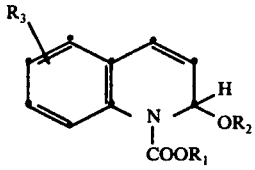

| Nr. | $R_1$ | $R_2$ | $R_3$ | Kp.(° C) | Fp.(° C) |
|---|---|---|---|---|---|
| VI/1. | $CH_3$ | $CH_3$ | H | 130° (0,3) | |
| VI/2. | $C_2H_5$ | $C_2H_5$ | H | | 64 - 66° |
| VI/3. | $CH_3$ | $C_2H_5$ | H | | 75 - 76° |
| VI/4. | $C_2H_5$ | $CH_3$ | H | 135-140° (0,6) | |
| VI/5. | $CH_3$ | $(CH_2)_2 . CH_3$ | H | 135-140° (0,3) | |
| VI/6. | $CH_3$ | $CH . (CH_3)_2$ | H | 135-140° (0,3) | |
| VI/7. | $CH_3$ | $(CH_2)_2 . OCH_3$ | H | 180-185° (0,4) | |
| VI/8. | $CH_3$ | $(CH_2)_2 . OC_2H_5$ | H | 162-168° (0,6) | |
| VI/9. | $CH_3$ | $(CH_2)_2 . SO_2 . CH_3$ | H | viscous oil | |
| VI/10. | $CH_3$ | $(CH_2)_2 . SO_2 . C_2H_5$ | H | " | " |
| VI/11. | $CH_3$ | $(CH_2)_2 . Cl$ | H | 135-150° (0,5) | |
| VI/12. | $CH_3$ | $(CH_2)_2 . \overset{\oplus}{N}(CH_3)_3\overset{\ominus}{Cl}$ | H | | |
| VI/13. | $C_2H_5$ | $(CH_2)_2 . CH_3$ | H | 140-145° (1,0) | |
| VI/14. | $C_2H_5$ | $CH . (CH_3)_2$ | H | 130-134° (0,5) | |
| VI/15. | $C_2H_5$ | $(CH_2)_2 . OCH_3$ | H | 160-165° (0,25) | |
| VI/16. | $C_2H_5$ | $(CH_2)_2 . OC_2H_5$ | H | 175-180° (0,25) | |
| VI/17. | $C_2H_5$ | $CH_2 . C_6H_5$ | H | 180-185° (0,15) | |
| VI/18. | $C_2H_5$ | $(CH_2)_2 . C_6H_5$ | H | 180-190° (0,15) | |
| VI/19. | $C_2H_5$ | $(CH_2)_2 . SO_2 . CH_2 . CH_3$ | H | viscous oil | |
| VI/20. | $C_2H_5$ | $(CH_2)_2 . Cl$ | H | 135-145° (0,5) | |
| VI/21. | $C_2H_5$ | $(CH_2)_2 . \overset{\oplus}{N}(CH_3)_3\overset{\ominus}{Cl}$ | H | | 140° (decomp.) |
| VI/22. | $C_2H_5$ | $(CH_2)_3 . CH_3$ | H | 137-139° (0,5) | |
| VI/23. | $(CH_2)_2 . OCH_3$ | $CH_3$ | H | 175-180° (0,3) | |
| VI/24. | $(CH_2)_2 . OCH_3$ | $(CH_2)_2 . OCH_3$ | H | 180-185° (0,3) | |
| VI/25. | $C_2H_5$ | $C_2H_5$ | $(5)SO_3Na$ | syrup | |
| VI/26. | $C_2H_5$ | $C_2H_5$ | $(8)OCH_3$ | 160(0,5) | |

Compounds according to formula VII

VII/1. 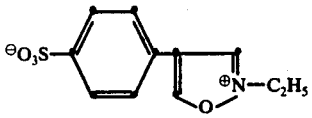

VII/2. 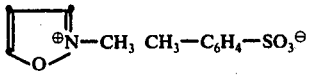

VII/3. 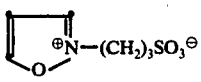

VII/4. 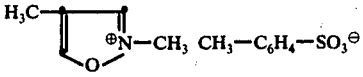

VII/5. 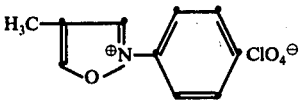

VII/6. 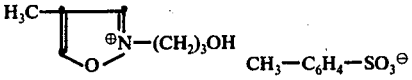

VII/9. 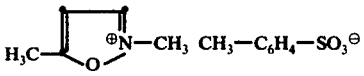

VII/10. 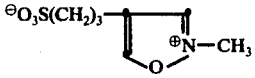

Compounds according to formula VIII

VIII/1. 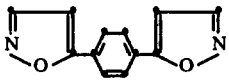

VIII/2. 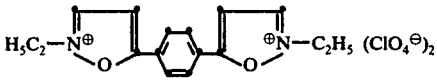

VIII/3. 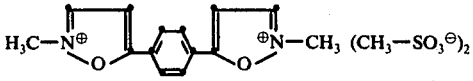

VIII/4. 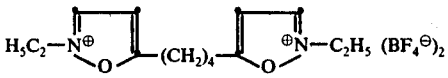

-continued

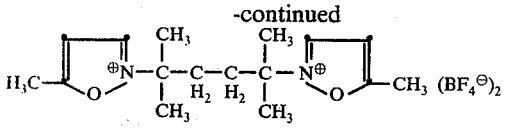

VIII/5.

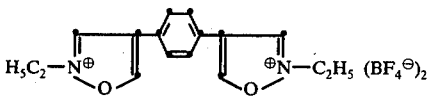

VIII/6.

The quick acting hardeners suitable for the process according to the invention are known per se. Details concerning methods of preparing them and their properties may be found in the following documents: Carbamoylonium compounds in British Patent Specification No. 1,385,630; German Offenlegungsschrift No. 2,439,551 and Belgian Patent Specification No. 829,895 and carbamoyloxypyridinium compounds in Belgian Patent Specification No. 825,726. Carbodiimide hardeners have been described in U.S. Pat. Nos. 2,938,892 and 3,098,693; in the work by E. Schmidt, F. Hitzler and E. Lahde in Ber. 71, 1935 (1938); by G. Amiard and R. Heynes in Bull. Soc. Chim. France 1360 (1956) and in German Offenlegungsschirft No. 2,439,553. Details of suitable dihydroquinoline compounds may be found in Belgian Patent Specification No. 816,410. Isoxazolium salts and bis-isoxazoles have been described, for example, in U.S. Pat. Nos. 3,316,095; 3,321,313; 3,543,292 and 3,681,372 and in British Patent Specification No. 1,030,882.

The hardener may either be added as an aqueous solution containing the wetting agent to the quantity of water used for adjusting the layer which is to be hardened to the correct state of swelling of the photographic layer already containing water may be covered with a concentrated hardener solution containing wetting agent. One, could, of course, also cover a dried layer with water and subsequently apply the concentrated solution of hardener in a separate operation. Whichever method is employed, the same quantity of water, based on the quantity of hardener, should be added to the layer per $cm^2$ or should already be contained in the layer. The degree of swelling can then be adjusted to values varying from 200 to 800% by varying the total quantity of water, and this degree of swelling can then be fixed by means of the quick acting hardeners.

For a given quantity of hardener, the degree of hardening of the layer depends on the degree of swelling, which means that the degree of hardening increases with decreasing quantities of water. The invention thus makes it possible to the degree of hardening independently of the quantity of hardener used, simply by altering the quantity of water, and one particularly interesting consequence of this is that hitherto unobtainable effects can be produced with relatively small quantities of hardener.

The amount of swelling to be adjusted by the process according to the invention for hardening the usual colour photographic recording materials composed of a plurality of protective layers, intermediate layers and emulsion layers containing gelatine is from 200 to 500 vols.%. The quantity of quick acting hardener used is generally from 1 to 7% by weight, based on the quantity of gelatine, and preferably 3 to 4% by weight. Inorganic complex forming compounds used for the preliminary hardening may be added in quantities of from 0.1 to 1% by weight. Suitable as complex-forming prehardeners are chromium, aluminium and zirconium salts.

The following are examples of suitable chromium compounds: Hydroxides; oxalates; citrates; malonates; lactates; tartrates; succinates; acetates; formates; sulphates; chlorides; nitrates and perchlorates. Suitable aluminium compounds include, for example, aluminium sulphate, potash alum and ammonium alum. Examples of suitable zirconium compounds include the complexes of zirconium with tartaric acid, citric acid, malonic acid, lactic acid and salicylic acid. The wetting agents used may be any of the surface active agents commonly used for the preparation of photographic materials, for example, saponin, perfluorinated sulphonic acid, succinic acid derivatives and non-ionic compounds containing polyethylene oxide.

When the photographic material which is to be hardened has been treated with a hardener solution as described above, the hardening effect achieved, which can be measured by the hoirzontal or vertical degree of swelling, can be influenced by the subsequent process of drying the layer. In this respect, the hardening process differs from previously known hardening processes in which such an effect cannot be obtained or can only be obtained to a limited extent and cannot be controlled.

After application of the hardener solution, it is necessary to keep a watch over the initial drying stage, which will hereinafter be referred to as the reaction phase.

During this reaction phase, the hardener should be allowed to diffuse into the combination of layers and at least to initiate the initial stages of the hardening reaction.

It has been found to be particularly advantageous, for a successful outcome of the hardening process according to the invention to follow the application of the hardener solution by a phase of reduced or completely arrested drying at not too low a temperature before the layer which is to be dried and hardened is subjected to the drying process proper.

When the colour photographic materials have the usual layer thicknesses when dry of from 12 to 25$\mu$, the duration of the reaction phase when using the instant hardeners mentioned above is generally between 10 and 200 seconds, depending on the temperature of the layer which is to be dried and hardened. The temperature of the layer should not drop below 12° C. during the reaction phase and should preferably be between 12° and 18° C.

These values can be adjusted without any particular difficulty by suitably controlling the process of drying by convection which is conventionally employed for the preparation of photographic layers. Reduction of the rate of drying can be achieved by restricting the quantity of drying air to zero, increasing the vapour content of the drying air or a combination of these two measures.

The second requirement, of maintaining the layers at a certain temperature, can be fulfilled by suitably adjusting the drying conditions, for example by combining them in accordance with Mollier's (i,x) diagram. From this diagram it is possible, for example, to determine the required moisture content and temperature of the drying air for a given temperature of film. Details may be found in the article by E. Buchholz, in the journal "Energie", Year 6, No. 10, October, 1954.

If the conditions described above are observed, optimum hardening is obtained.

It was also found that the degree of moisture of the layer to which the solution of hardener is applied has a significant influence on the action of the hardener.

It was surprisingly found that the smaller the quantity of residual water in the layer or layer combination treated with the hardener, the more vigorously this hardening takes place. This was unexpected since known hardeners such as triacryloformate, for example, are well known to harden more intensely the higher the moisture content of the layer to be hardened.

It has been found to be particularly advantageous to adjust the residual moisture content of the layers to be hardened to a level of about 15 to 30%, based on the dry weight of the gelatine.

Depending on the method employed for coating the layers with the reactive solutions, it may be advantageous to add thickeners to the coating solutions to improve their casting properties. Hydrophilic polymers or gelatine which have film-forming properties but do not react or react only slowly with the hardeners in dilute aqueous solution are chosen for this purpose. The following are examples of suitable thickeners: Cellulose, cellulose derivatives, polyalkylene oxides, polyvinyl alcohol and its derivatives, polyvinyl sulphonic acid or styrene sulphonic acid and copolymers, sulphoalkylsubstituted polyacrylates, polymethacrylates, polyacrylamides and polymethacrylamides.

The hardeners described here may be used either singly or as mixtures. The process according to the invention is also advantageous for hardening photographic layers in which the binder does not consist exclusively of gelatine but also contains other homopolymers and copolymers which contain carboxyl groups.

By photographic layers are meant in this context any layers generally used in photographic materials, for example light-sensitive silver halide emulsion layers, protective layers, filter layers, antihalation layers, backcoating layers or photographic auxiliary layers in general.

The light-sensitive emulsion layers for which the hardening process according to the invention is particularly suitable include, for example, those layers which are based on emulsions which have not been sensitized, X-ray emulsions and other spectrally sensitized emulsions. The hardening process according to the invention has also proved to be suitable for hardening gelatine layers used for the various black-and-white and colour photographic processes such as negative, positive and diffusion transfer processes, or printing processes. The process according to the invention has been found to be particularly advantageous for hardening photographic layer combinations used for carrying out colour photographic processes, for example combinations containing emulsion layers with colour couplers or emulsion layers which are to be treated with solutions containing colour couplers.

The light-sensitive components in the emulsion layers may be any silver halides such as silver chloride, silver iodide, silver bromide, silver iodobromide, silver chlorobromide or silver bromoiodochloride. The emulsions may be chemically sensitized with noble metal compounds, e.g. with compounds, e.g. with compounds of ruthenium, rhodium, palladium, iridium, platinum or gold such as ammonium chloropalladate, potassium chloroplatinate, potassium chloropalladite or potassium chloroaurate. They may also contain special sensitizers consisting of sulphur compounds, tin(II) salts, polyamides or polyalkylene oxide compounds. The emulsions may also be optically sensitized, for example with cyanine dyes, merocyanine dyes or mixed cyanine dyes.

Lastly, the emulsions may contain various water-soluble or emulsified, water-insoluble couplers, colourless couplers, coloured couplers, stabilizers such as mercury compounds, triazole compounds, azaindene compounds, benzothiazolium compounds or zinc compounds, wetting agents such as dihydroxyalkanes, substances for improving the film forming properties, e.g. the particulate high polymers dispersible in water which are obtained from emulsion polymerisation of copolymers of alkylacrylate or methacrylate with acrylic or methacrylic acid, the copolymers of styrene and maleic acid and the copolymers of styrene and maleic acid anhydride semialkyl esters, coating auxiliaries such as polyethylene glycol lauryl ether and various other photographic additives.

Apart from gelatine, the layers may contain other hydrophilic colloids such as colloidal albumen, agar-agar, gum arabic, dextrans, alginic acid, cellulose derivatives, for example with an acetyl content of from 19 to 26%, hydrolysed celluloseacetate, polyacrylamides, imidatised polyacrylamides, zein, vinyl alcohol polymers containing urethane/carboxylic acid groups or cyanoacetyl groups such as vinyl alcohol/vinylcyanoacetate copolymers, polyvinyl alcohols, polyvinyl pyrrolidones, hydrolysed polyvinyl acetates, polymers of the kind obtained by the polymerisation of proteins or saturated acylate proteins with monomers containing vinyl groups, polyvinyl pyridines, polyvinylamines, polyaminoethylmethacrylates and polyethyleneimines.

It was not foreseeable that by controlling the cross-linking reaction by means of the amount of swelling according to the invention, the cross-linking activity of the quick-acting hardeners would be able to be varied as desired within certain limits.

If a low degree of swelling is maintained during the cross-linking reaction, the degree of cross-linking obtained with a given quantity of hardener is greater than that obtained when the swelling is greater. The process according to the invention therefore provides a saving in the quantity of hardener used. This is an important advantage since the products of hydrolysis and reaction of quick acting hardeners are responsible for numerous photographic faults, particularly for the increase in photographic fogging and loss in sensitivity which take place during storage of the photographic materials.

When layers which have been treated according to the invention have been dried, the degree to which they swell in aqueous baths is largely independent of the quantity of quick acting hardener used and depends only on the extent of swelling of the layer at the moment when cross-linking takes place. Since the quick acting hardener has either undergone reaction or been decomposed by the time drying has been completed, it is found that storage of the layers in a tropical cupboard (7 days at 30° C. and 80% relative humidity) causes no reduction in swelling and no increase in the degree of hardening, i.e. no after-hardening takes place.

The effect of the hardening compound is determined in terms of the melting point of the layers, which can be measured as follows:

When the layer has been cast on a substrate, it is half dipped in water which is continuously heated to 100° C. The temperature at which the layer runs off the substrate (formation of streaks) is taken as the melting point or melting off point. By this method of measurement, pure protein or gelatine layers untreated with hardener in no case show any increase in melting point. The melting off point obtained under these conditions is in the region of 30° to 35° C.

To determine the wet scratch resistance, a metal tip of specified size is passed over the wet layer and loaded with a progressively increasing weight. The wet scratch resistance is given as the weight at which the tip leaves a visible scratch trace on the layer. A heavy weight corresponds to a high wet scratch resistance and hence a high degree of hardening.

The following examples serve to explain the invention. The percentages given in the examples are percentages by weight unless otherwise indicated.

EXAMPLE 1

An aqueous solution of a hardener of the formula $$C_2H_5-N=C=N-(CH_2)_3-\overset{H}{\underset{\oplus}{N}}(CH_3)_2\ Cl^{\ominus}$$

containing a wetting agent at a concentration of 1% in water, which carried sulphonic acid groups and is represented by the formula $$Na^{\oplus}\ SO_3-\underset{\underset{CH_2-COO-C_8H_{17}}{|}}{CH}-COO-C_8H_{17}$$

was applied to a gelatine layer 20μ in thickness which contained silver halide and had been prehardened with 0.5% by weight of basic chromium acetate, based on the quantity of gelatine. The said gelatine layer was supported on a cellulose triacetate substrate. The aqueous solution of hardener was applied so that the quantity of hardener, based on the quantity of gelatine, was always the same in three wet applications 40μ, 60μ and 80μ in thickness, and amounted to 2.5% by weight in each case. The layers were dried within 3 minutes, after the hardener solution had been allowed to act for 30 seconds, and they were then stored at room temperature for 24 hours. The swelling factor and wet scratch resistance were determined after 5 minutes development at 38° C. in a black-and-white developer.

| Wet Application | Melting point of layer | Swelling factor | Wet scratch resistance |
|---|---|---|---|
| 40 μ | >100° | 4.2 | 950 p |
| 60 μ | >100° | 5.5 | 600 p |
| 120 μ comparison | >100° | 7.5 | 350 p |

In spite of the fact that the same quantity of hardener was used in each case, i.e. 2.5% based on the quantity of gelatine, the degree of swelling obtained varied according to the quantity of wet application. The hardening effect increases with decreasing quantity of wet application. This means that the degree of hardening can be increased by lowering the wet application without altering the quantity of hardener.

The swelling factors obtained with a wet application of 120μ were found to be disadvantageous for processing purposes. The surfaces of the layers obtained could easily be damaged mechanically.

EXAMPLE 2

Example 1 was repeated except that in this case the gelatine contained 20% by weight of a water-insoluble colour component in an emulsified form in addition to the silver halide. The colour component corresponded to the following general formula

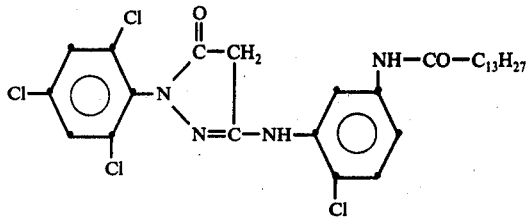

A colour developer of the following composition was used in this case for determining the swelling factors and wet scratch resistances:

| | |
|---|---|
| Potassium carbonate | 37.5 g |
| Sodium sulphate | 4.25 g |
| Sodium bromide | 1.3 g |
| Hydroxyl ammonium sulphate | 2.0 g |
| Isopropanoldiamino-tetracetic acid | 2.5 g |
| p-hydroxyethyl-ethylamino-toluidine sulphate | 4.75 g |
| potassium iodide | 0.002 g |
| water up to | 1 litre |
| pH ($H_2SO_4$) | 10.0. |

The development time was 3¼ minutes at 38° C.

| Wet application | Swelling factor | Wet scratch resistance |
|---|---|---|
| 40 μ | 4.2 | 700 p |
| 60 μ | 4.8 | 500 p |
| 120 μ comparison | 6.4 | 300 p |

All layer melting points were above 100° C.

In this case again, the hardening activity of the hardener increased with decreasing wet application. A wet application of 120μ resulted in swelling factors which were useless for practical purposes and the surfaces of the layers obtained were extremely sensitive to mechanical damage.

EXAMPLE 3

Example 2 was repeated except that in this case the gelatine contained a water-soluble colour component of the following formula

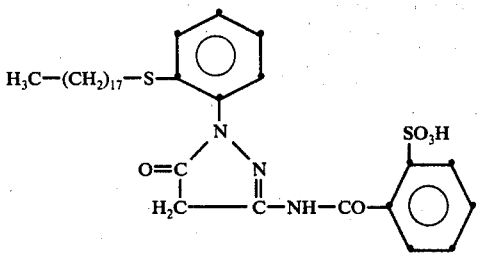

and 0.7% by weight of chrome alum as hardener, in addition to silver halide.

| Wet application | Swelling factor | Wet scratch resistance |
|---|---|---|
| 40 μ | 4.5 | 500 p |
| 60 μ | 5.7 | 400 p |
| 120 μ | 8.4 | 300 p |

-continued

| Wet application | Swelling factor | Wet scratch resistance |
|---|---|---|
| comparison | | |

All layer melting points were above 100° C.

The results obtained in Examples 1 to 3 show that the greatest hardening is achieved with the least wet application.

EXAMPLE 4

20% by weight, based on the quantity of gelatine, of a magenta coupler of the following formula

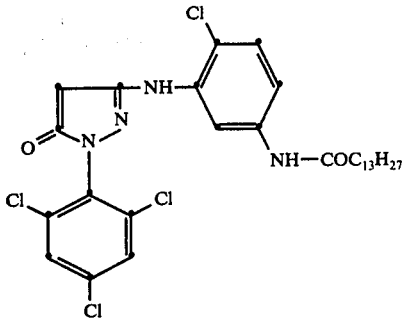

was added in emulsified form with crystalloid dibutyl phthalate (1:1) to an unhardened silver halide emulsion which contained 10% by weight of gelatine.

The usual casting additives, in addition to 0.5% by weight of chromium acetate used as prehardener, were then added to the emulsion. The mixture was poured on a prepared substrate of polyethylene terephthalate and dried. The thickness of the layer was 8.0μ(water content <15%).

Samples of these layers were then covered with aqueous solutions of the carbodiimide of the formula $$C_3H_7-N=C=N-(CH_2)_3-\overset{\oplus}{\underset{H}{N}}(CH_3)_2\ Cl^{\oplus}$$

containing 2% by weight of the wetting agent $$Na^{\oplus}\ SO_3^{\ominus}-\underset{}{\overset{CH_2-CO-O-i\,.\,Octyl}{\overset{|}{CH}}}-CO-NH-SO_2-C_{15}H_{31}$$

the solutions being applied in quantities such that while the wet applications varied, the quantity of hardener used for a given quantity of gelatine remained constant at 2.6% by weight.

The hardener was given 30 seconds to diffuse into the layers and the layers were then dried at temperatures below 30° C. for 3 minutes.

After drying, the layers were stored at 22° C. for one day and developed at 38° C. in the colour developer indicated in Example 2. The swelling factor and wet scratch resistance were then determined.

Part of the material which had been covered with aqueous carbodiimide was aged for 36 hours at 57° C. and 34% relative humidity and tested again.

| Wet application | Fresh sample | | Aged sample | |
|---|---|---|---|---|
| | Swelling factor | Wet scratch resistance | Swelling factor | Wet scratch resistance |
| 20 μ | 3.5 | 700 p | 3.3 | 700 p |

-continued

| Wet application | Fresh sample | | Aged sample | |
|---|---|---|---|---|
| | Swelling factor | Wet scratch resistance | Swelling factor | Wet scratch resistance |
| 30 μ | 5 | 500 p | 4.9 | 500 p |
| 50 μ | 6.7 | 300 p | 6.2 | 300 p |
| comparison | | | | |

All layer melting points were above 100° C.

As can be seen from the results, little or no after-hardening occurs. The after-hardening is greatest when the wet applications are high.

The results also show that the intensity of hardening increases with decreasing wet application and that swelling factors which render the materials useless for practical purposes are obtained when the wet application is 50μ.

The following example illustrates the advantageous effect which the delay in the onset of drying has on the swelling and hardening of the material.

EXAMPLE 5

A multilayered colour photographic film consisting of the following layers was prehardened with 0.5% by weight of basic chromium acetate, based on the dry weight of gelatine:

1. A red sensitive foundation layer 4μ in thickness containing 35 g of silver bromide, 80 g of gelatine and 24 g of 1-hydroxy-2-[Δ(2,4-di-tert.-amylphenoxy)-n-butyl]naphthamide per kg of emulsion,
2. an intermediate layer of gelatine 2μ in thickness,
3. a green sensitive middle layer 4μ in thickness containing 35 g of silver bromide, 80 g of gelatine and 16 g of 1-(2,4,6-trichlorophenyl)-3-[3-{α(2,4-di-tert.-amylphenoxy)acetamido}-benzamido]-5-pyrazolone per kg of emulsion,
4. a yellow filter layer 2μ in thickness, consisting of colloidal silver in gelatine,
5. a blue-sensitive top layer 4μ in thickness containing 35 g of silver bromide, 80 g of gelatine and 20 g of [3{α(2,4-di-tert.-amylphenoxy)acetamido}benzoyl]-2-methoxy-acetanilide per kg of emulsion and
6. a protective layer of gelatine 2μ in thickness The multilayered film described above had a thickness of 18μ.

The film was then covered with an aqueous solution of a hardener corresponding to one of the following formulae

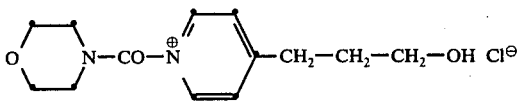

(1)

or

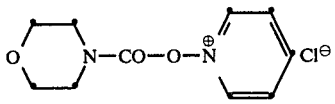

(2)

containing 3% of saponin. The thickness of this covering layer when wet was 50μ and the concentration of the hardener was adjusted so that 3% by weight of hardener was applied, based on the weight of gelatine.

The multilayered film covered with hardener solution as described above was dried by a jet of air at a temperature below 30° C. Drying was started either immediately after application of the layer containing the hardener or after a delya of 60 seconds.

The operating conditions and results are summarised in the following Table.

| Sample | Delay after casting in seconds | Air temperature ° C | Swelling factor | Wet scratch resistance in P |
|---|---|---|---|---|
| 1 | A immediately after casting | ≦ 30° C | 4 | 200 |
| | B 60 | | 2.8 | 450 |
| 2 | A immediately after casting | ≦ 38° C | 4.2 | 200 |
| | B 60 | | 3.0 | 480 |

A comparison between Samples A and B shows that when drying is preceded by an interval during which little or no drying takes place, the swelling factor is reduced and hardening increased.

EXAMPLE 5a

A multilayered film was prepared as described in Example 5 but the individual layers were in this case not prehardened with chromium acetate.

When microscopic sections of the multilayered films were examined under the microscope and compared, it was found that there was a clear distinction between the individual layers in the film prepared according to Example 5 whereas in the layers which had not been prehardened, the lower layer began to dissolve at its interface when it was covered over with the next layer. Signs of melting of the layers were observed and led to imperfect separation of the colours in the colour developed materials. This shows that prehardening is necessary for obtaining technically perfect colour photographic materials.

EXAMPLE 6

The following series of experiments demonstrates the influence of the moisture content in the layer which is to be hardened on the swelling characteristics and degree of hardening.

A silver halide emulsion layer (thickness of dry layer 12μ) which had been prehardened with 0.7% by weight of chrome alum, based on the dry weight of the gelatine, was applied to a cellulose triacetate substrate layer which had been covered with an adhesive layer. Individual samples of the silver halide emulsion layer were dried to the following residual moisture contents:

Sample 1: 2.65 g of $H_2O/m^2$ corresponding to 22%
Sample 2: 1.85 g of $H_2O/m^2$ corresponding to 15%
Sample 3: 1.70 g of $H_2O/m^2$ corresponding to 14%
Sample 4: 1.55 g of $H_2O/m^2$ corresponding to 13%.

The residual moisture contents were determined by Fischer's method, the moisture content of the substrate being eliminated in each case.

The individual samples were then covered with aqueous solutions of a hardener applied to form layers 45μ in thickness. The solutions contained the wetting agent indicated in Example 1 in the quantity indicated there.

The hardeners used and their quantities are shown in the following table:

After 30 seconds, all the samples were dried for 3 minutes in a stream of air having a temperature of 30° C. and a moisture content of 5 g of water per kg of air.

The following results were obtained:

| Hardener | Concentration | Swelling factor at residual moisture contents of 13% | 14% | 15% | 22% |
|---|---|---|---|---|---|
| Compound IV/16 | 1.5% | 4.15 | 4.4 | 5.0 | 5.4 |
| Compound III/15 | 2.0% | 4.85 | 5.1 | 6.1 | 6.9 |
| Compound I/28 | 2.0% | 5.3 | 5.4 | 6.4 | 6.8 |

The results show that if the hardeners are applied very wet, a distinct increase in swelling and reduction in hardness results within residual moisture contents of between 15% and 22%.

EXAMPLE 7

An aqueous solution of the following compound

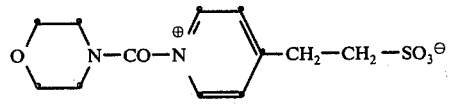

containing a wetting agent carrying sulphonic acid groups and containing 2 per cent of wetting agent of the following formula:

$$\begin{array}{l} CH_2-COO-CH_2-CH_2-(C_2H_5)-C_4H_9 \\ | \\ CH-CO-NH-SO_2-C_{15}H_{31} \\ | \\ SO_3Na \end{array}$$

was applied to a dry gelatine layer 20μ in thickness which contained silver halide and had been prehardened with 0.5% by weight of basic chromium acetate, based on the quantity of gelatine.

The quantity of hardener used, based on the dry weight of gelatine, was adjusted to 3% by weight (wet application 60μ). The length of time allowed for the hardener to act after its application, during which no drying was carried out, was varied. After these varying lengths of time, the samples were all dried in the same manner at temperatures below 30° C. The swelling factors and wet scratch resistances were determined in the usual manner.

| Reaction time without drying | Layer melting point | Swelling factor | Wet scratch resistance |
|---|---|---|---|
| 0 sec | 10'100° C | 6.3 | 450 p |
| 30 sec | | 5.5 | 550 p |
| 60 sec | | 5.4 | 600 p |
| 120 sec | | 5.3 | 650 p |

The Table shows that, as the reaction time is increased, so the hardening activity obtained from one and the same quantity of hardener also increases. After a reaction time of 60 seconds, hardening increases only slightly with time. Reaction times above 200 seconds serve no useful purpose.

We claim:

1. Process for hardening photographic layers which contain gelatin in multilayer photographic films comprising silver halide emulsion layers and layers which contain gelatin and light-insensitive photographic layers containing gelatin including the step of applying a solution a quick acting hardener which activates carboxyl groups, in quantities from 1 to 7% by weight and based on the quantity of gelatin, wherein the improvement comprises the step, before applying the quick acting hardener, of incorporating in the surface of a photographic layer which contains gelatin, a pre-hardener selected from the group consisting of complex forming organic and inorganic salts of aluminum, chromium and zirconium in quantities from 0.1 to 1% by weight based on the quantity of gelatin, to provide in the multilayered photographic films water and gelatin having a melting point above 35° C.

and then subsequently carrying out the step of applying the quick acting hardner in an aqueous solution containing additional water in amount sufficient to provide a total amount of water in said films which provides swelling of the multi-layered photographic films in a range of between 200 and 500 volumes percent and maintaining the swelling for a period of 10 to 200 seconds and then drying the multilayer photographic films at a temperature below 30° C.

2. Process according to claim 1, wherein by the quick acting hardener is of the formula

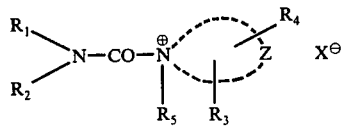

in which $R_1$ represents a substituted or unsubstituted alkyl, aryl or aralkyl group, $R_2$ represents either (1) a substituted or unsubstituted alkyl, aryl or aralkyl group having the same meaning as $R_1$ or (2) an alkyl, aryl aralkyl or alkyl-aryl-alkyl group substituted with another carbamoylammonium group of the formula

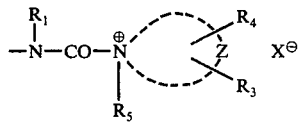

or $R_1$ and $R_2$ may together present the atoms required to complete a substituted or unsubstituted heterocyclic ring;

$R_3$ represents hydrogen, alkyl or the group $[A]\alpha$ in which A represents a vinyl group of a polymerisable vinyl compound or of a copolymer with other copolymerisable monomers and $\alpha$ represents a number such that the molecular weight of the compound is greater than 1000;

$R_4$ represents hydrogen or alkyl or, when Z represents the atoms required to complete a pyridinium ring and $R_3$ is absent, $R_4$ represents a formylamino, acyl-amino or ureido group which may be unsubstituted or substituted on the nitrogen atom, an alkyl group substituted with acylamino or ureido groups which may in turn be substituted or unsubstituted amido group, an alkyl group substituted with an amido group which may itself be substituted, a straight or branched chain alkyl group substituted with hydroxyl, alkyl, formyloxy acyloxy or carbamoyloxy which may itself be substituted, or a straight or branched chain alkyl group substituted with an amino, alkylamino, formylamino, acylamino or ureido group;

$R_5$ represents alkyl, aryl or aralkyl but is absent when the nitrogen atom to which $R_5$ would normally be attached carries a double bond in the heterocyclic aromatic ring formed by Z;

Z represents the atoms required to complete a 5-membered or 6-membered substituted or unsubstituted heterocyclic aromatic ring, including a condensed ring system, which may contain one or more additional hetero-atoms, and X represents an anion.

3. Process according to claim 1, wherein the quick acting hardener is of the formula

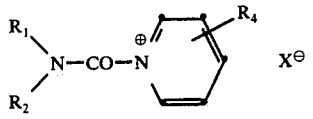

in which $R_1$, $R_2$ and X have the meaning already specified and $R_4$ represents one of the following formulae:

$-NR^6-CO-R^7$ in which $R^6$ represents hydrogen or alkyl (1-4 C)

$R^7$ represents hydrogen or alkyl (1-4 C) or $NR^8R^9$ in which $R^8$ and $R^9$ represents hydrogen or alkyl ($C_1$-$C_4$)

$-(CH_2)_m-NR^{10}R^{11}$ in which $R^{10}$ represents $-CO-R^{12}$ $R^{11}$ represents hydrogen or alkyl ($C_1$-$C_4$)

$R^{12}$ represents hydrogen, alkyl ($C_1$-$C_4$) or $NR^{13}R^{14}$ in which $R^{13}$ represents alkyl ($C_1$-$C_4$) or aryl $R^{14}$ represents hydrogen alkyl or aryl and $m = 1$ to 3

$-(CH_2)_n-CONR^{15}R^{16}$ in which $R^{15}$ represents hydrogen, alkyl ($C_1$-$C_4$) or aryl $R^{16}$ represents hydrogen or alkyl ($C_1$-$C_4$) or $R^{15}$ and $R^{16}$ may together represent the atoms required to complete a 5-membered or 6-membered aliphatic ring and $n = 0$-3

FORMULA in which $R^{17}$ represent hydrogen or alkyl ($C_1$-$C_4$) which may be substituted by halogen, Y represents —O—, $-NR^{19}-$ $R^{18}$ represents hydrogen, alkyl, $-CO-R^{20}$ or $-CO-NHR^{21}$ $R^{19}$, $R^{20}$, $R^{21}$ = H, alkyl ($C_1$-$C_4$)

$p = 2$-3

4. Process according to claim 1, wherein by the quick acting hardener is of the formula

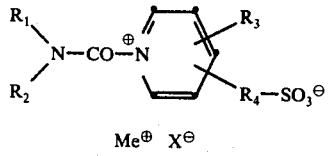

in which $R_1$ and $R_2$ which may be the same or different represent an alkyl group having from 1 to 3 carbon atoms, an aryl group which may be unsubstituted or substituted with $C_1$-$C_2$ alkyl or halogen, or an aralkyl group which may be unsubstituted or substituted with $C_1$–$C_2$ alkyl or with halogen; or $R_1$ and $R_2$ may together represent the atoms required to complete a piperidine or morpholine ring which may be substituted with a $C_1$–$C_2$ alkyl or with halogen;

$R_3$ represents hydrogen, methyl or ethyl, $R_4$ represents ethylene or a single chemical bond, $Me^+$ represents an alkali metal cation and $X^-$ represents a chloride or bromide anion.

5. Process according to claim 1, wherein by the quick acting hardener is of the formula

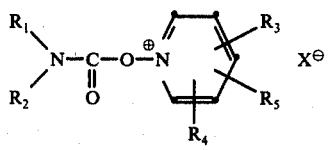

in which $R_1$ represents alkyl or aryl, $R_2$ represents alkyl or the group

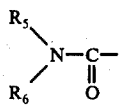

$R_7$ represents hydrogen or alkyl and $R_6$ represents alkyl; or $R_1$ and $R_2$ together represent the atoms required to complete a heterocyclic ring system such as a pyrrolidine, morpholine, piperidine, perhydroazepine, 1,2,3,4-tetra-hydroquinoline or imidazolidine-2-one ring, or $R_1$ and $R_2$ together represent the atoms required to complete a piperazine ring in which the second nitrogen atom establishes the connection to a similar, second molecular grouping corresponding to the general formula, $R_3$ represents hydrogen, halogen, alkyl, oxyalkyl, cyanogen, $CONH_2$ or NH—C—O alkyl, $R_4$ represents hydrogen or alkyl, $R_5$ represents hydrogen or methyl and X represents an anion.

6. Process according to claim 1, wherein by the quick acting hardener is of the formula $$R_1—N=C=N—R_2$$

in which $R_1$ and $R_2$ which may be the same or different represent alkyl, alkoxyalkyl, an aryl group which may be substituted or a 5-membered, heterocyclic ring which may be substituted or $R_1$ represents alkyl with 1 to 5 carbon atoms and $R_2$ represents the group

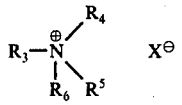

in which $R_3$ represents alkyl with 1 to 5 carbon atoms and $R_4$ and $R_5$ represent alkyl with 1 to 3 carbon atoms or $R_4$ and $R_5$ together form a 6-membered heterocyclic ring having one or two hetero atoms, $R_6$ represents hydrogen or a lower alkyl group and X represents an anion.

7. Process according to claim 1, wherein by the quick acting hardener is of the formula

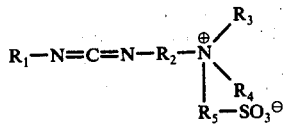

in which $R_1$ represents alkyl with 1 to 6 carbon atoms, cycloalkyl or alkoxyalkyl $R_2$ represents alkylene with 2 to 4 carbon atoms, $R_3$ represents alkyl with 1 to 3 carbon atoms, $R_4$ represents alkyl with 1 to 3 carbon atoms or aryl or $R_3$ and $R_4$ together represent the atoms required to complete a 6-membered heterocyclic ring which may contain other hetero atoms in addition to the nitrogen atom, $R_5$ represents alkylene with 1 to 4 carbon atoms.

8. Process according to claim 1, wherein by the quick acting hardener of the formula

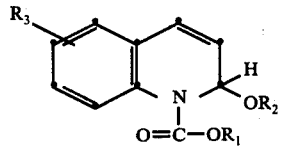

in which $R_1$ represents substituted or unsubstituted alkyl, $R_2$ represents substituted or unsubstituted alkyl or aralkyl or, when $R_3$ is hydrogen $R_2$ represents the group

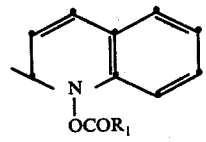

and $R_3$ represents hydrogen, halogen, alkyl or alkoxy.

9. Process according to claim 1, wherein by the quick acting hardener is of the formula

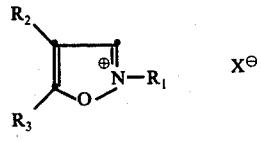

in which $R_1$ represents an aliphatic hydrocarbon group having from 1 to 4 carbon atoms which may contain a sulphonate anion $R_2$ and $R_3$ represent hydrogen, an unsubstituted alkyl, an unsubstituted aryl or an alkyl or aryl substituted with halogen, hydroxyl, alkyl, alkoxy and/or a sulphonate anion, or a simple heterocyclic ring, or $R_2$ and $R_3$ together form an alicyclic ring, and X represents an anion which renders the compound water-soluble, X being absent when $R_1$, $R_2$ or $R_3$ already contains or contain a sulphonate anion.

10. Process according to claim 1, wherein by the quick acting hardener is of one of the formulae

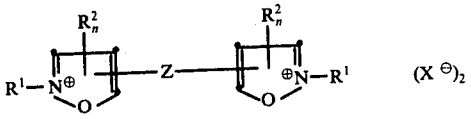

-continued

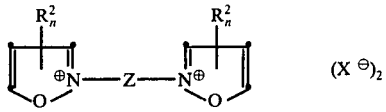

in which

Z represents a divalent aliphatic or aromatic group, $R_1$ represents an aliphatic hydrocarbon group having from 1 to 4 carbon atoms, $R_2$ represents alkyl, cycloalkyl or aryl if it is not attached in its 3-position to a ring,

*n* represents an integer of from 0 to 2 and

X represents an anion.

11. The process according to claim 1, wherein the complex forming compounds are basic chromium acetate or chrome alum.

12. Process according to claim 1, characterised in that the gelatine layers of a colour photographic multilayered material are hardened.

* * * * *